US006112776A

United States Patent [19]

Berktold

[11] Patent Number: 6,112,776

[45] Date of Patent: Sep. 5, 2000

[54] WEFT MONITORING INSERTION SYSTEM FOR A PLURALITY OF DIFFERENT WEFT THREADS

[75] Inventor: Klaus Berktold, Rüti, Switzerland

[73] Assignee: Sulzer Textil AG, Rüti, Switzerland

[21] Appl. No.: 09/407,036

[22] Filed: Sep. 27, 1999

[30] Foreign Application Priority Data

Oct. 7, 1998 [EP] European Pat. Off. ..... 98811008

[51] Int. Cl.[7] ..... D03D 47/38; D03D 51/34

[52] U.S. Cl. ..... 139/453; 139/370.2

[58] Field of Search ..... 139/453, 370.2

[56] References Cited

U.S. PATENT DOCUMENTS

| | | | |
|---|---|---|---|
| 3,833,026 | 9/1974 | Domig | 139/370.2 |
| 4,785,856 | 11/1988 | Gehring et al. | 139/453 |
| 4,924,917 | 5/1990 | Shaw | 139/452 |
| 5,322,090 | 6/1994 | Dornier et al. | 139/452 |
| 5,477,892 | 12/1995 | Corain et al. | 139/370.2 |

FOREIGN PATENT DOCUMENTS

| | | |
|---|---|---|
| 0816545A1 | 1/1978 | European Pat. Off. . |
| 0333302A1 | 9/1989 | European Pat. Off. . |
| 550 879 | 6/1974 | Switzerland . |
| 2278129A | 11/1994 | United Kingdom . |

*Primary Examiner*—Andy Falik

*Attorney, Agent, or Firm*—Townsend and Townsend and Crew LLP

[57] ABSTRACT

The weaving machine with a weft monitoring insertion system (1) for a large number of different weft threads (11, 11', 11") comprises a weft insertion member (6, 60), thread brakes (3), a weft thread selector (4) for the serving of a thread (11, 11', 11") or of more than one thread at the same time, a thread monitor (51) for weft threads (11) which are correctly inserted, and an electronic and programmable control member (8) for the setting of the thread brakes. The weft threads (11), when correctly inserted, form incoming angles (α) at the thread monitor in the presence of a deflection which depend on the choice of the weft thread. Utilizing the thread monitor (51) a signal can be produced for the control member (8) which is dependent on the incoming angle and the thread tension. Control signals can be calculated and produced in the control member as a result of this signal and as a result of information on the current serving of the weft thread or of the weft threads, i.e. of the presentation of the threads to be inserted through the weft thread selector (4).

8 Claims, 3 Drawing Sheets

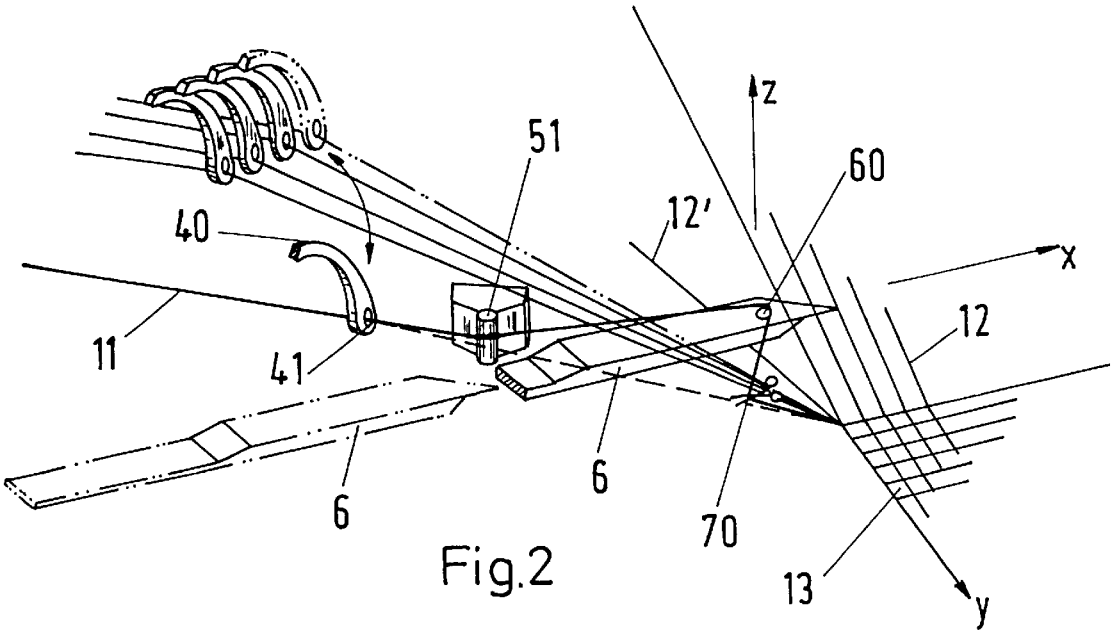
Fig.2
Fig3a
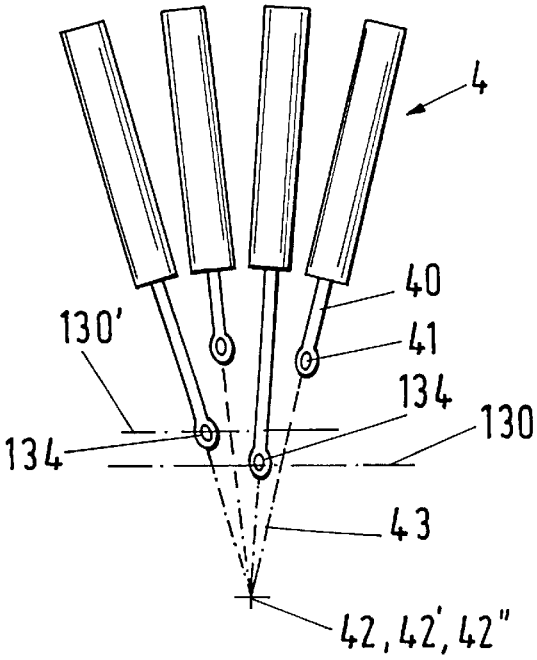
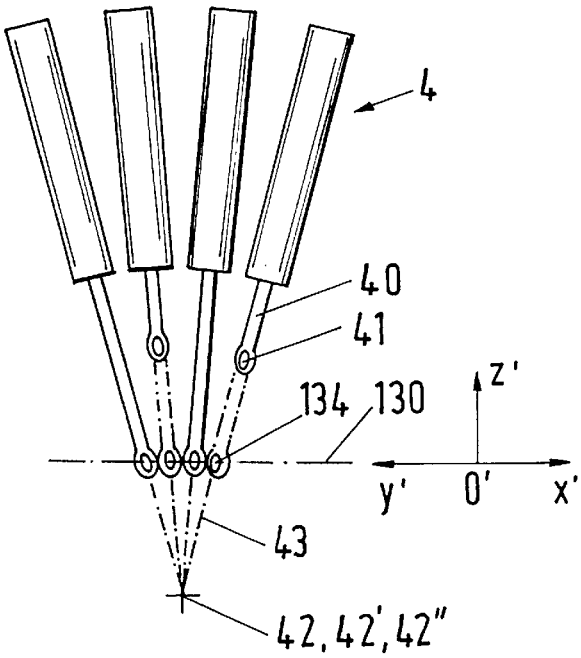
Fig.3b

WEFT MONITORING INSERTION SYSTEM FOR A PLURALITY OF DIFFERENT WEFT THREADS

BACKGROUND OF THE INVENTION

The invention relates to a weaving machine with a weft monitoring insertion system for a plurality of different weft threads a weft monitoring insertion system for a plurality of different selected and non-selected weft threads. It also relates to a method for the operation of a weaving machine of this kind.

A rapier weaving machine is known from EP-A 0 816 545 (=T.964) with an apparatus which recognises incorrectly inserted weft threads. This weaving machine with a weft monitoring insertion system is provided for the manufacture of cloths (fabrics) into which a large number of different weft threads are woven. On account of restricted space conditions in the region of the thread server there are, in addition to correctly inserted threads, occasionally also co-moving weft threads which are also inserted by the weft insertion member without an intended cause. Therefore it is proposed in the named specification to provide, in addition to a first weft thread monitor, a second weft thread monitor for the monitoring of co-moving weft threads.

The first weft thread monitor can be used to measure the thread tension force. As a result of the measurement values obtained with a thread monitor of this kind, thread brakes of the insertion system can be set in such a manner that a situation is avoided in which damaging thread tensions are exceeded.

For certain cloths it is necessary that two or more threads be inserted into the shed at the same time by the weft insertion member. A multiple weft insertion of this kind (or double insertion in the case of two weft threads inserted together) makes the manufacture of an impeccable cloth even more difficult. The object of the invention is now to create a weaving machine with an insertion system by means of which, on the one hand, the weft thread tension can be regulated and by means of which, on the other hand, a multiple weft insertion is also possible. In this only one thread monitor is to be used for the tension monitoring of correctly inserted weft threads. Faulty insertions through co-moving threads should be avoided by means of the use of at least one further thread monitor.

SUMMARY OF THE INVENTION

The weaving machine with a weft monitoring insertion system for a plurality of different weft threads comprises a weft insertion member, thread brakes, a weft thread selector for the serving of a thread or of more than one thread at the same time, a thread monitor for weft threads which are correctly inserted, and an electronic and programmable control member for the setting of the thread brakes. The weft threads, when correctly inserted, form incoming angles at the thread monitor in the presence of a deflection which depend on the choice of the weft thread. A signal dependent on the incoming angle and the thread tension can be produced for the control member by means of the thread monitor. Control signals can be calculated and produced in the control member as a result of this signal and as a result of information on the current serving of the weft thread or of the weft threads, i.e. of the presentation of the threads to be inserted by the weft thread selector.

The solution in accordance with the invention permits a weft thread monitoring with a single head thread tension sensor. With the latter the correct insertion for all weft threads (henceforth "color" for short) to be served by the weft thread selector ("color selector" for short) can be monitored and regulated. In this a "color selector" can be used which permits a multiple weft thread serving in which the "colors" which are intended for the weft insertion are served with a staggered presentation so that weft threads which are served at the same time do not mutually hinder one another. In a double weft thread insertion, for example, all "colors" can thus be combined with one another as desired. In a staggered presentation the weft thread serving takes place at different incoming angles.

A weaving machine and a process of operating a weaving machine is set forth.

DESCRIPTION OF THE DRAWINGS

In the following the invention will be explained with reference to the drawings. Shown are.

DESCRIPTION OF THE PREFERRED EMBODIMENTS

Figure 1:
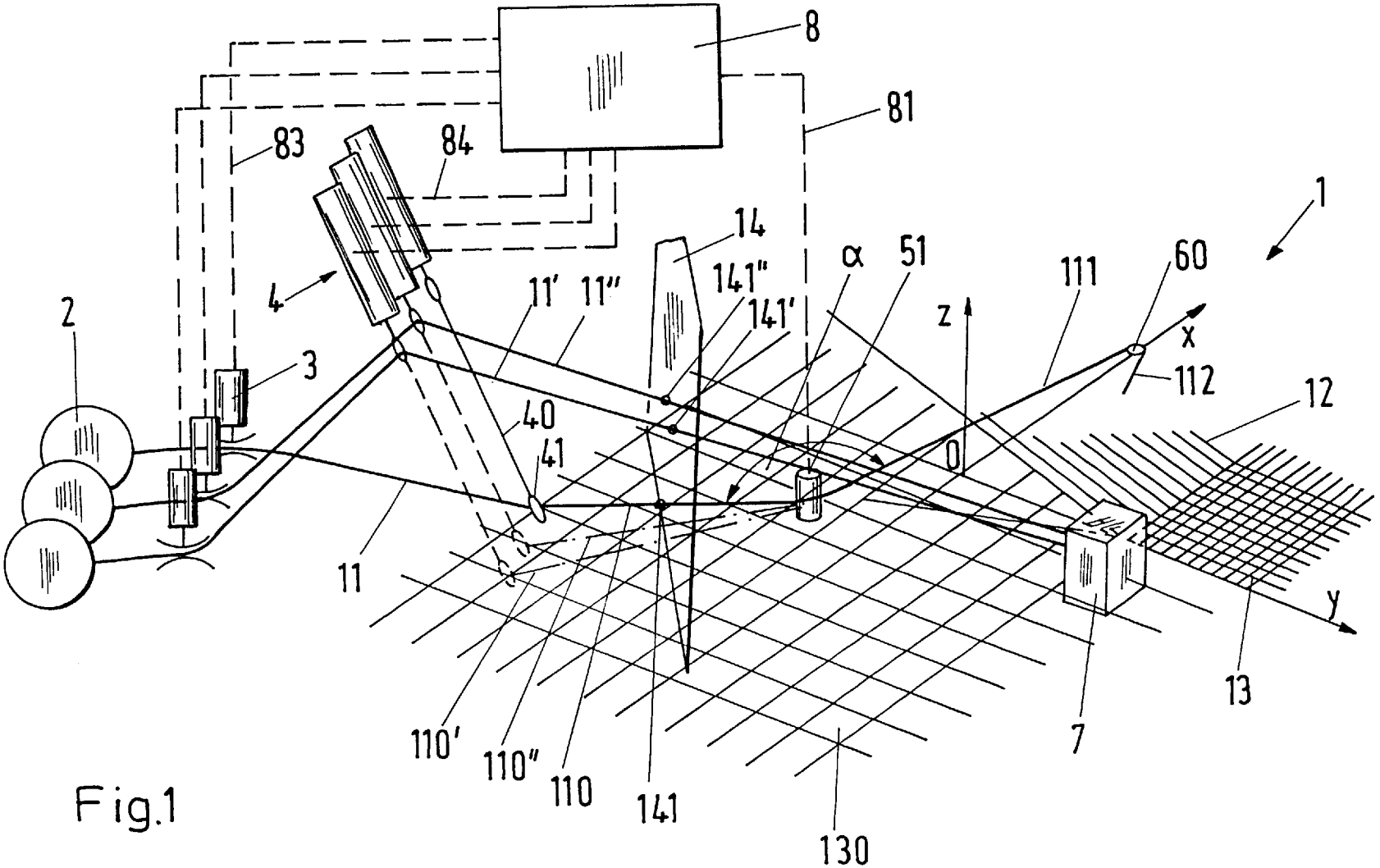
FIG. 1 a schematic illustration of the spatial arrangement which shows the constituents of the insertion system of the weaving machine in accordance with the invention, FIG. 2 section-wise, the weft thread insertion system of a rapier weaving machine, FIGS. 3*a, b* are elevations of the thread server units ("color selectors")

The insertion system 1 shown in FIGS. 1 and 2 is part of a weaving machine by means of which a cloth 13 is manufactured from warp threads 12 and weft threads 11, 11' and 11"; it comprises the following components:

- weft thread delivery devices 2 which comprise non-illustrated bobbins and stores for the "color" 11, 11' and 11";
- controllable thread brakes 3 by means of which the thread tension forces of the individual "color" can be regulated;
- a "colour selector" 4 which for each "color" moves an eye 41 between a high position and a low position with a thread server 40, with the presentation of the "colour" taking place in the low position;
- a single head thread tension sensor which acts as a thread monitor 51;
- a weft insertion member 6, in particular a rapier (which can be moved back and forth by means of a drive band or a drive bar in a shed which is formed by the warp threads 12, see FIG. 2), of which merely one thread clamp 60 is illustrated in FIG. 1;
- a device 7 in which the already pre-cut ends of the threads of all colors 11, 11' and 11" are releasably fixed, which can also be a shear 70 (cf. FIG. 2) which cuts off the thread of the "color" 11 to be inserted from the cloth during the weft insertion;
- furthermore an electronic and programmable control member or device 8 for the setting of the thread brakes 3 which is connected via a line 81 to the thread monitor 51, via lines 83 to the thread brakes 3 and via lines 84 to the thread selector 4.

For the sake of clarity an example with only three "colors" 11, 11' and 11" has been illustrated. As a rule up to eight "colors" 11 are woven in with rapier weaving machines;

more than eight are however also possible. Likewise for greater clarity the distance between the high and low position of the eyes 41 is drawn exaggeratedly large.

The weft insertion plane 130 is the x-y plane through the origin O of a Cartesian coordinate system x-y-z; it is illustrated as a coordinate network. The low positions of the eyes 41 lie in the plane 130 or adjacently in a plane parallel to this plane 130. The weft insertion takes place in the x direction. The warp threads 12 and the produced cloth 13, which—at least approximately—also lies in the plane 130, move in the y direction. A (non-material) plane 14 which is parallel to the z axis is also drawn in as a pictorial plane for the illustration of the "color selector" 4 (see FIG. 3). The threads 11, 11' and 11" intersect this plane 14 at the points 141, 141' and 141" respectively. As a result of the deflection at the thread monitor 51 the weft thread 11 forms an angle, the incoming angle α, between an incoming segment 110, which extends between the eye 41 and the thread monitor 51, and an insertion segment 111. A thread segment 112 which is free at its one end at the clamp 60 forms the thread end which remained after the cutting in the device 7 or by means of the shear 70.

The other two "colors" 11' and 11" form incoming segments 110' and 110" corresponding to the "color" 11. Because of a staggered arrangement of the low position of the eyes these incoming segments 110' and 110" include incoming angles α with the insertion segment 111 which have different values. An individual incoming angle α is in each case associated with the "colors" 11, 11' and 11". The threads, which are deflected at the thread monitor 51, act on the latter with a resultant force of the thread tension forces, which depends on the incoming angle α. This force is measured by the thread monitor 51. A corresponding information signal is produced and transmitted via the line 81 to the control member 8. There a corrected control signal which corresponds in a reversably unique manner to the tension force of the thread is calculated from the information signal taking into account the incoming angle α. The values for the incoming angle α which is associated with the various "colors" must be retrievably stored in the control member 8. The information as to which color or colors has been or have been selected is transmitted via the line 84 to the control member 8 so that the actual thread tension forces can be calculated. With the calculated control signal the brake force of the thread brakes 3 is finally influenced via the lines 83 so that tensions at which damage can arise can not be exceeded in the threads.

When a plurality of weft threads 11 are presented at the same time the number of weft, threads is also taken into account in the calculation of the corrected control signal.

As a result of the corrected control signal the speed of rotation of the weaving machine and/or the driving of the weft insertion member can additionally be regulated for the influencing of the movement sequence.

FIG. 3*a* represents a normal projection of a "color selector" 4 onto the pictorial plane 14 which is illustrated in FIG. 1 (projection of the coordinate system: O', x', y', z'). This "color selector" 4 has a particular embodiment (different from that in FIG. 1): For each thread 11 to be served it comprises a thread server 40 with the eye 41, which is linearly displaceable or else pivotal (FIG. 2). During the serving the eye 41 passes through points on a line or a curve section 43 of which one end point 42 is located closer to a serving or presentation point 134 lying in the plane 130. As a rule the end points 42 have different distances from the pictorial plane 14 which is illustrated in FIG. 1, but lie however on a common line of "alignment" 42'. (This line 42' is at least approximately straight. It extends in the direction of the thread monitor 51. The pictorial plane 14 is perpendicular to the line 42'. Therefore the line 42' and the end points 42 of the curve sections 43 appear as a single point 42" in the projection onto the pictorial plane 14.)

The height positions of the serving points 134 can be provided so as to be differently selectable with respect to the plane 130. This is illustrated in FIG. 3*b:* a serving point 134' is located on a plane 130' parallel to the plane 130.

The end points of the position curve sections 43 are arranged on rays which intersect at different angles at the projection point 42" of the line 42' in the normal projection onto the plane 14. The serving points 134 are so far removed from the end points 42 that no mutual hindrance results during a serving of a plurality of weft threads 11 at the same time.

Figure 4:
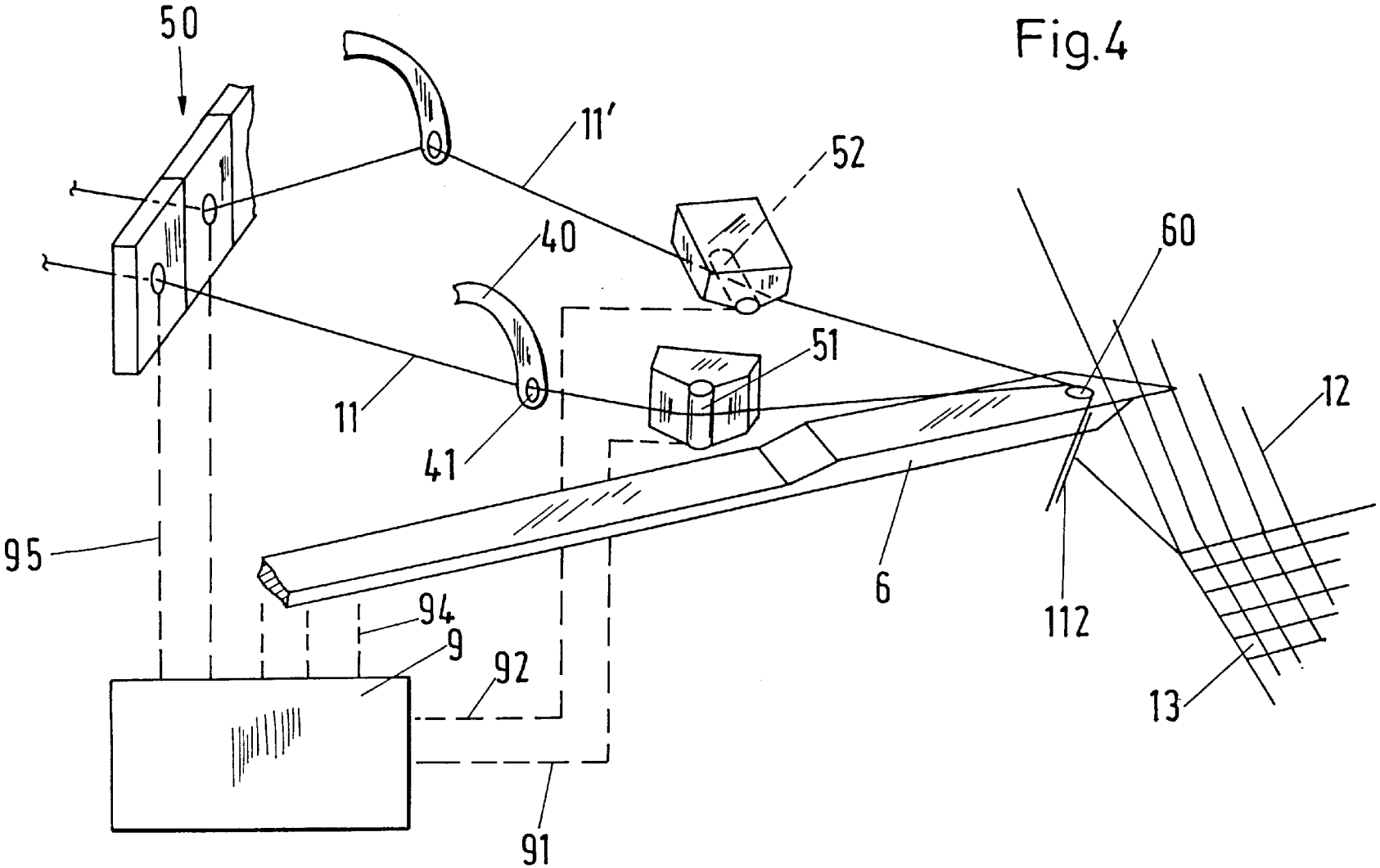
FIG. 4 is a schematic of a weft thread insertion system with a second thread monitor for the detection of co-moving weft threads.

FIG. 4 represents a weft monitoring insertion system in which eye weft thread monitors 50 with a settable sensitivity are arranged between the thread brakes 3 (not shown) and the "color selector" 4 (only thread server 40 with eyes 41 is shown). In addition to the first thread monitor 51 a second thread monitor 52 is provided for the monitoring of co-moving weft threads which are co-inserted by the weft insertion member without an intended cause (for details see the initially named EP-A 0 816 545). The faulty insertion of a co-moving weft thread 11' is represented.

An electronic control unit 9 is provided for setting the sensitivity of the eye weft thread monitor 50, which is required for an ideal thread detection. Between the control unit 9 and the thread monitors 51 and 52 there are connections 91 and 92 for signal transmissions. Further connections 94 and 95 to the "color selector" 4 and to the sensors of the eye weft thread monitor 50 are present. Each individual weft thread 11, 11', 11" can be monitored with the control unit 9 during the weft insertion. A program of the control unit 9 recognises on the basis of the color control (connection 94) which "colours" are served to the rapier. As a result of the information received the control unit 9 sets one of the possible sensitivity stages of the sensors of the eye weft thread monitor 50 in accordance with a program.

The thread monitor 51 in FIG. 1 as well as the two thread monitors 51 and 52 in FIG. 4 can be designed in such a manner that they produce suitable control signals using optical, piezoelectric, magnetic and/or further electrical means. Means of this kind are described in somewhat more detail in EP-A 0 816 545.

What is claimed is:

1. A weaving machine with a weft monitoring insertion system for a plurality of different weft threads comprising:

a weft insertion member having a path for weft thread insertion of different weft threads selected for insertion to the weaving machine;

thread brakes for acting on each of the different weft threads;

a weft thread selector for serving selected different weft threads into and out of the path of the weft insertion member from the thread brakes;

a first weft thread monitor for monitoring the selected different weft threads to produce a signal when a weft thread is selected for insertion, the first weft thread monitor for monitoring the selected different weft threads producing a signal dependent upon the incoming angle and selected different weft threads to the first weft thread monitor;

an electronic and programmable control member for the setting of the thread brakes responsive to the first thread monitor and the weft thread selector; and, a second weft thread monitor for monitoring different weft threads which are not selected for insertion to detect inadvertent insertion of weft threads not selected for insertion.

2. A weaving machine with a weft monitoring insertion system for a plurality of different weft threads including:

a weft insertion member having a path through a serving point for weft thread insertion of different weft threads selected for insertion to the weaving machine;

thread brakes for acting on each of the different weft threads;

a weft thread monitor for monitoring the different weft threads;

a weft thread selector for serving selected different weft threads into and out of the serving point of the weft insertion member from the thread brakes and the weft thread monitor;

the weft thread selector having a plurality of thread servers for a corresponding plurality of weft threads, each thread server having a weft thread passing through an eye on the thread server;

the plurality of thread servers each moveable along a movement path in that during the serving the eye passes along the movement path aligned to the thread monitor which is at least approximately a line directed toward the weft thread monitor, and, the movement paths together each having one end point lying closer to the serving point and in that the totality of these movement paths pass parallel to a plane of alignment so that when the movement paths are projected to the plane of alignment, the movement paths intersect one another at different angles at a projection point and the serving points are remote from the projection point so that no mutual hindrance results in the simultaneous serving of a plurality of weft threads.

3. The weaving machine with a weft monitoring insertion system according to claim 2 and wherein:

the movement paths are linear.

4. The weaving machine with a weft monitoring insertion system according to claim 2 and wherein:

the movement path are arcuate.

5. A weaving machine with a weft monitoring insertion system for a plurality of different weft threads including:

a weft insertion member having a path for weft thread insertion of different weft threads selected for insertion to the weaving machine;

thread brakes for acting on each of the different weft threads;

a first thread monitor for monitoring the different weft threads to produce a first signal when a weft thread is selected for insertion and a second signal when a weft thread is not selected for insertion;

a weft thread selector for serving selected different weft threads into and out of the path of the weft insertion member from the thread brakes and the thread monitor;

a second weft monitor for monitoring different weft threads not selected for insertion;

an electronic and programmable control unit connected to the weft thread selector for setting the sensitivity for ideal thread detection at the first thread monitor and the second thread monitor to determine correct selection of the selected different weft threads and weft threads not selected for insertion to the weaving machine.

6. A process of utilizing a weaving machine for a plurality of different weft threads comprising:

providing a weft insertion member having a path for weft thread insertion of different weft threads selected for insertion to the weaving machine;

providing thread brakes for acting on each of the different weft threads;

providing a weft thread selector for serving selected different weft threads into and out of the path of the weft insertion member from the thread brakes;

providing a first thread monitor for monitoring the selected different weft threads to produce a signal when a weft thread is selected for insertion;

producing a signal at the first thread monitor dependent upon the incoming angle and selected different weft threads to the first thread monitor;

controlling the setting of the thread brakes responsive to the first thread monitor and the weft thread selector; and, providing a second weft monitor for monitoring different weft threads which are not selected for insertion to detect inadvertent insertion of weft threads not selected for insertion.

7. A process of using weaving machine for a plurality of different weft threads including:

providing a weft insertion member having a path for weft thread insertion of different weft threads selected for insertion to the weaving machine;

providing thread brakes for acting on each of the different weft threads;

providing a thread monitor for monitoring the different weft threads;

providing a weft thread selector for serving selected different weft threads into and out of the path of the weft insertion member from the thread brakes and the thread monitor;

the provided the weft thread selectors having a plurality of thread servers for a corresponding plurality of weft threads, each thread server having a weft thread passing through an eye on the thread server; and, moving the plurality of thread servers along a movement paths in that during the serving the eye passes along the movement paths aligned to the thread monitor which is at least approximately a line directed toward the weft thread monitor, and, aligning the movement paths together so that each movement paths has one end point lying closer to the serving point and in that the totality of these movement paths pass parallel to a plane of alignment so that when the movement paths are projected to the plane of alignment, the movement paths intersect one another at different angles at a projection point and the serving points are remote from the projection point so that no mutual hindrance results in the simultaneous serving of a plurality of weft threads.

8. A process of using a weaving machine with a weft monitoring insertion system for a plurality of different weft threads including:

providing a weft insertion member having a path for weft thread insertion of different weft threads selected for insertion to the weaving machine;

providing thread brakes for acting on each of the different weft threads;

providing a first thread monitor for monitoring the different weft threads to produce a first signal when a weft thread is selected for insertion and a second signal when a weft thread is not selected for insertion;

providing a weft thread selector for serving selected different weft threads into and out of the path of the weft insertion member from the thread brakes and the thread monitor;

providing a second weft monitor for monitoring different weft threads not selected for insertion;

setting the sensitivity for ideal thread detection at the first thread monitor and the second thread monitor to determine correct selection of the selected different weft threads and weft threads not selected for insertion to the weaving machine.

* * * * *